United States Patent [19]

Glass et al.

[11] 4,450,975

[45] May 29, 1984

[54] WALL-MOUNTED ASH TRAY

[75] Inventors: William T. Glass; Michael T. Glass, both of Kalamazoo, Mich.

[73] Assignee: Mark Designs International, Inc., Kalamazoo, Mich.

[21] Appl. No.: 354,002

[22] Filed: Mar. 2, 1982

[51] Int. Cl.[3] ..... B65D 25/22; A24F 19/00

[52] U.S. Cl. ..... 220/18; D27/8; D27/14; 131/257; 248/131

[58] Field of Search ..... D27/8, 14; 220/18; 131/257; 248/313

[56] References Cited

U.S. PATENT DOCUMENTS

| | | | |
|---|---|---|---|
| D. 168,213 | 11/1952 | Coller | D27/14 |
| D. 209,890 | 1/1968 | Hogt | D27/8 |
| D. 215,776 | 10/1969 | Glass . | |
| D. 215,779 | 10/1969 | Glass . | |
| 1,868,023 | 7/1932 | North . | |
| 2,196,356 | 4/1940 | Sipo | 248/313 |
| 2,353,363 | 7/1944 | Sanford . | |
| 2,353,364 | 7/1944 | Sanford | 248/313 |
| 2,707,473 | 5/1955 | Lowi . | |
| 3,001,753 | 9/1961 | Smith | 248/313 |
| 4,151,972 | 5/1979 | Allegro . | |

FOREIGN PATENT DOCUMENTS

| | | | |
|---|---|---|---|
| 1386519 | 3/1975 | United Kingdom | 248/313 |

*Primary Examiner*—George E. Lowrance

*Attorney, Agent, or Firm*—Flynn, Thiel, Boutell & Tanis

[57] ABSTRACT

A wall-mountable ash tray assembly, including a one-piece U-shaped bracket having a bight which directly attaches to a vertical support surface. The bracket has parallel arms which project outwardly from the bight and have upwardly opening recesses formed therein. An ash tray provided with cuplike side flanges is removably but securely supported on the bracket due to the side flanges being securely and snugly positioned within the recesses formed in the bracket arms. An article-supporting hook can be positioned to the support surface directly below the bracket. A protective accent plate can also be secured to the wall directly above the bracket in the region adjacent the upper edge of the ash tray.

4 Claims, 5 Drawing Figures

WALL-MOUNTED ASH TRAY

FIELD OF THE INVENTION

This invention relates to an improved wall-mounted assembly which includes a removable ash tray.

BACKGROUND OF THE INVENTION

Numerous wall-mountable ash tray assemblies are known, and such assemblies are extensively utilized in public facilities such as governmental and commercial buildings. These known wall-mounted ash tray assemblies have, for the most part, been structurally complex and of large size, so that they have hence been relatively expensive, and have also often created a rather unsightly appearance. Such assemblies have also normally employed an ash receptacle which can not be readily removed and cleaned, so that maintenance of such ash tray assemblies has been a significant and continuous problem. Because of the size and/or appearance of most known wall-mounted ash tray assemblies, oftentimes their usage has been considered wholly unacceptable, and thus large floor-supported ash tray assemblies are used in place thereof. Such free-standing or floor-supported ash trays, however, are also bulky, expensive and unsightly, and thus possess many recognized disadvantages.

Accordingly, this invention relates to an improved wall-mountable ash tray assembly which overcomes or at least greatly minimizes most of the disadvantages associated with known assemblies of this type. More specifically, in the improved wall-mounted ash tray assembly of this invention, there is provided a simple U-shaped bracket formed from thin platelike material, which bracket readily attaches to a wall or other vertical support surface. The bracket has a pair of outwardly projecting parallel arms, and an ash tray is positioned between and supported on these arms. The ash tray includes a substantially rectangular ash receptacle which opens upwardly and which is snugly accommodated within the bracket. A pair of cuplike ears are fixed to the ash receptacle and project outwardly from opposite ends thereof. These ears are snugly accommodated within enlarged recesses formed in the upper edges of the bracket arms so that the ash tray is stably and stationarily supported on and within the bracket, but can be readily removed for cleaning by lifting the ash tray upwardly so as to remove the ears from the recesses. The cuplike ears also function as a stable and safe support for a cigarette.

In improved ash tray assembly, as aforesaid, there can also be provided a substantially planar accent plate which is positioned on the supporting wall directly above the height of the bracket, which accent plate hence protects the wall area directly above the ash receptacle. The ash tray assembly, as aforesaid, can also be provided with a hook which secures to the wall directly below the bight of the bracket, which hook defines a large hook portion at the lower free end thereof for permitting an object, such as a purse or briefcase, to be supported thereon. The provision of this accent plate and hook is particularly desirable when the ash tray assembly is provided within a public facility, such as a public telephone, a rest room or the like.

Thus, one of the objects of this invention is to provide an improved wall-mounted ash tray assembly, as aforesaid, which assembly is siimple and inexpensive to manufacture, which is compact and of light weight, which can be easily installed on an existing wall or vertical support surface, which can be easily cleaned and maintained, and which does not significantly effect or harm the aesthetics of the supporting wall and surrounding environment.

It is also an object of the invention to provide an improved wall-mounted ash tray assembly, as aforesaid, which provides for a safe and secure stationary mounting of a removable ash tray in such manner as to provide for functional, practical and safe handling of ashes and lit cigarettes, while at the same time providing an ash tray which is practical and accessible for convenient use, while still being readily removable in its entirety from the support bracket to facilitate cleaning and maintenance thereof. The size and configuration of the ash tray assembly, and particularly its compactness and its minimal projection from a wall or vertical supporting surface, hence increases the safety of such a wall-mounted ash tray and also reduces or minimizes the obstruction caused by such wall-mounted ash trays, particularly when used in public hallways and the like.

A further object of the invention is to provide an improved wall-mounted ash tray assembly, as aforesaid, which while it permits the ash tray to be readily and wholly removed from the support bracket for cleaning purposes, nevertheless the ash tray is otherwise very securely and stationarily supported on the bracket so as to prevent its accidental dislodgment due to accidentally applied sideward pressure or excessive downward pressure by a person snuffing a cigarette. This improved ash tray assembly permits the ash tray to be removed solely by vertically lifting same upwardly away from the support bracket, and since this is the direction in which the ash tray is least apt to be accidentally moved, the likelihood of accidental dislodgment of the ash tray is hence minimized. At the same time, supporting the ash tray on the bracket in this manner simplifies its removal without requiring the use of auxiliary detents or other devices for holding the ash tray in position.

Other objects and purposes will be apparent to persons familiar with assemblies of this type upon reading the following specification and inspecting the accompanying drawings.

Figure 1:
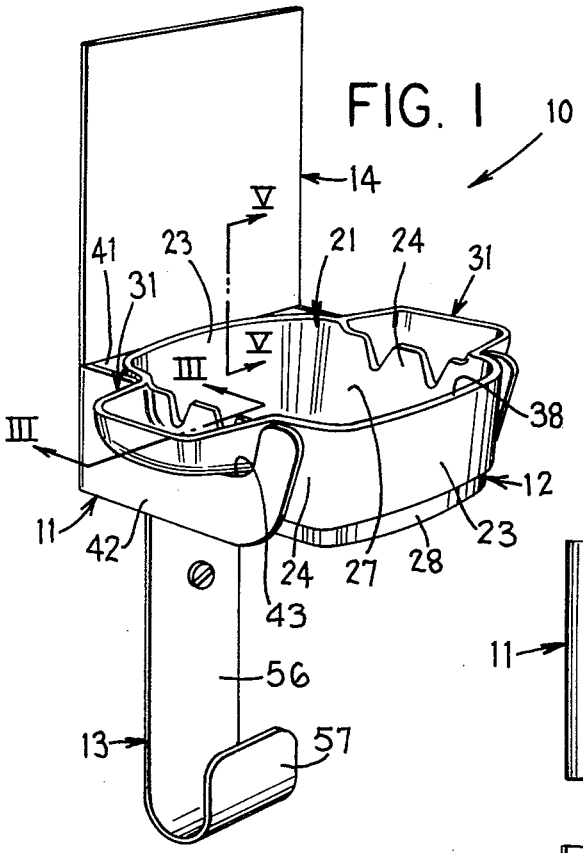
FIG. 1 is a perspective view of the improved wall-mounted assembly of this invention, which assembly includes not only the ash tray but also an optional accent plate and support hook located respectively above and below the bracket.
Figure 5:
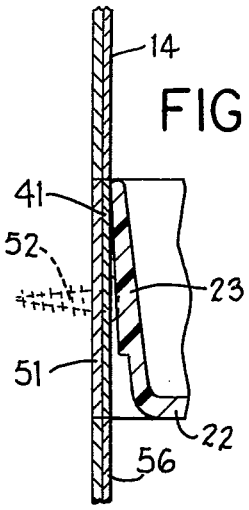
FIG. 5 is a fragmentary, sectional view taken substantially along line V—V in FIG. 1.
Figure 4:
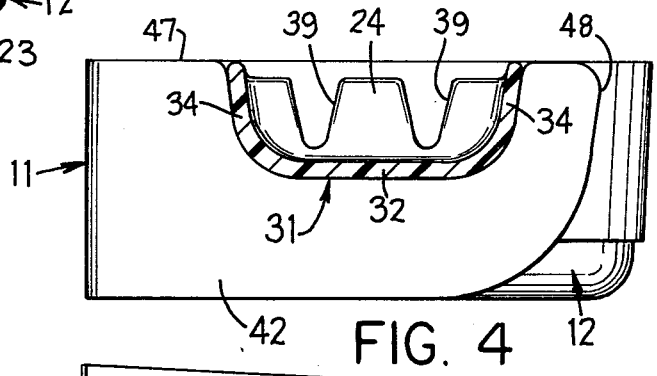
FIG. 4 is a fragmentary, sectional view taken substantially along line IV—IV in FIG. 3.
Figure 3:
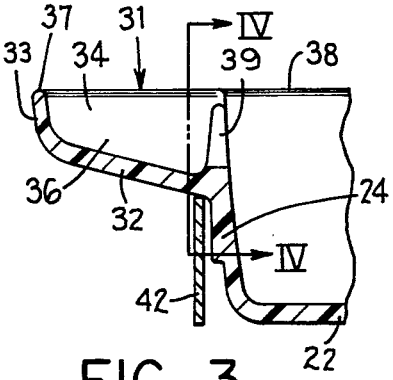
FIG. 3 is a fragmentary, sectional view taken substantially along line III—III in FIG. 1.

Certain terminology will be used in the following description for convenience in reference only, and will not be limiting. For example, the words "front" and "back" will refer to the sides of the assembly which are respectively remote from or directly adjacent the wall or supporting surface. The words "inward" and "outward" will refer to directions toward and away from, respectively, the geometric center of the assembly and designated parts thereof. Said terminology will include the words specifically mentioned, derivatives thereof and words of similar import.

DETAILED DESCRIPTION

Referring to the drawings, there is illustrated the improved wall-mounted ash tray assembly 10 according to the present invention. This assembly 10 includes a wall-mounted bracket 11 which removably supports thereon an ash tray 12. The assembly can also incorporate a support hook 13 which mounts below the bracket, and an accent plate 14 which mounts above the bracket.

Considering first the ash tray 12, this ash tray is known and in fact is disclosed in my earlier U.S. Pat. No. Des. 215,776. However, the structure of the ash tray 12 will be briefly described to insure a complete understanding thereof, and particularly its relationship to the wall bracket.

As illustrated by FIGS. 1 and 3–5, the ash tray includes a main boxlike receptacle 21 which opens upwardly and, when viewed from above, has a substantially square configuration, although the side and end walls are somewhat curved or rounded. This receptacle 21 includes a substantially horizontally planar bottom wall 22 which is secured to identical front and rear walls 23, which in turn are joined together by identical side walls 24. These walls 23 and 24, in cooperation with the bottom wall 22, hence define a rather large ash-receiving chamber 27. The walls 23 and 24, adjacent the bottom wall, define therein a stacking recess 28 which extends completely around the bottom of the receptacle 21 to facilitate the vertical stacking and partial nesting of like ash trays for shipping, storing and handling purposes.

The ash tray 12 includes a pair of identical cigarette-supporting cups 31 which are fixed to and project outwardly from the side walls 24 on opposite sides of the ash tray. Each of these supporting cups 31 includes a substantially planar bottom wall 32 which is fixed to the respective side wall 24 approximately midway between the upper and lower edges thereof, with this bottom wall 32 being slightly upwardly inclined as it projects outwardly away from the respective side wall 24. The cup 31 also includes an outer edge wall 33 and opposite side edge walls 34 which are connected to the bottom wall 32 through intermediate rounded corners, and which project upwardly therefrom so that the supporting cup 31 thus defines therein a recess 36. The upper edge of the supporting cup 31, as indicated by the upper edge 37 of the outer edge wall 33, is substantially planar with the upper edge 38 of the receptacle 21.

The upper central portion of the side wall 24, specifically that portion which separates the ash chamber 27 from the recess 36, is provided with one and preferably at least two cigarette-receiving notches or recesses 39 therein. These recesses 39 open downwardly from the upper edge of the side wall, and are sized so as to accommodate the cross section of a cigarette therein. These recesses terminate at their lower ends in the vicinity of the bottom wall 32.

The structure of the ash tray 12 as described above is known, and is also illustrated in my aforementioned U.S. Pat. No. Des. 215,776.

Considering now the wall-mounted bracket 11, same is formed as a one-piece channel or U-shaped member and same includes a base or bight 41 having a pair of parallel arms 42 integrally fixed thereto and projecting outwardly from opposite ends thereof. This U-shaped bracket member 11 is preferably formed from thin platelike metal and is suitably shaped so that the bight 41 comprises a thin but vertically enlarged flat plate which will lie flush with a wall or other vertical supporting surface. The parallel arms 42 are integral with the bight 41, such as by being bent at 90° angles therefrom, so that the arms 42 are also thin horizontally but are vertically enlarged planar platelike members which project perpendicularly outwardly away from the bight 41, and hence away from the supporting wall. The horizontal spacing between the parallel arms 42 is selected so as to permit the boxlike receptacle 21 of the ash tray to be snugly accommodated therein.

Each of the bracket arms 42 has a large recess 43 formed therein, which recess is positioned intermediate the ends of the respective arm and opens downwardly from the upper edge thereof. The recess 43 has a vertical depth which is approximately one-half the overall height of the bracket arm 42. This recess 43 is bounded by a substantially straight and horizontal bottom edge 44 which, at its opposite ends, terminates in curved end edges 46 which project upwardly for intersection with the upper edge of the bracket arm. The recesses 43 are shaped and sized so as to snugly accommodate therein the cigarette-supporting cups 31 which project outwardly from opposite sides of the ash tray 12. These recesses 43 have a width and configuration, when viewed from front to back, which closely conforms with the cross-sectional configuration of the supporting cups 31, and hence the bottom recess wall 44 supportingly engages the bottom wall 32 so as to positively prevent downward displacement of the ash tray. Similarly the curved end edges 46 of the recess closely confine the opposite sides of the supporting cup 31 so as to prevent the ash tray from moving horizontally forwardly or rearwardly relative to the bracket. This arrangement hence stationarily and stably supports the ash tray.

With the ash tray supported on the bracket, substantially as illustrated by FIG. 1, the depth of the recess 43 results in the upper edge of the ash tray, as defined by the edges 37 and 38, being approximately coplanar with the upper edge of the bracket. Further, the recesses are positioned in spaced relationship from the bracket bight 41 by a distance such that the rear wall 23 of the ash tray is positioned closely adjacent, and substantially in contact with, the bight 41. The bracket arms 42 terminate in free ends which are spaced slightly forwardly of the recesses 43, which free ends are appropriately rounded as illustrated at 48 so as to improve the appearance and eliminate sharp corners. Further, these rounded free ends 48 are positioned so as to not project outwardly beyond the front wall of the ash tray and, in fact, are preferably positioned slightly rearwardly from the front wall of the ash tray.

To secure the bracket 11 to a wall or other vertical supporting surface, the bight 41 is preferably provided with an adhesive means 51 which, in a preferred embodiment, comprises a strip of double-stick tape having one side thereof stuck to the rear surface of the bight 51 so as to cover substantially the total surface area thereof. The other or rearward side of the tape is normally provided with a removable protective film which can be readily removed so as to facilitate the securement of the bracket to a supporting wall. In addition, the bight 41 has a pair of spaced holes therethrough for permitting suitable fasteners, such as screws 52, to extend therethrough and into the wall so as to securely attach the bracket thereto. These screws are hidden by the ash tray when the latter is mounted on the bracket.

With the ash tray 12 mounted on the bracket 11 as described above, and as illustrated by FIG. 1, the ash tray is stationarily and stably supported so as to permit it to be used for snuffing of cigarettes, and it can also be readily used for deposit of lighted cigarettes thereon. For this purpose, the lighted cigarette is positioned so as to extend across the supporting cup 31 in a conventional manner. However, when cleaning or emptying of the ash tray is desired, it can be easily grasped and lifted upwardly in its entirety so as to totally remove it from the bracket, following which it can be emptied and cleaned, and then repositioned on the bracket.

Figure 2:
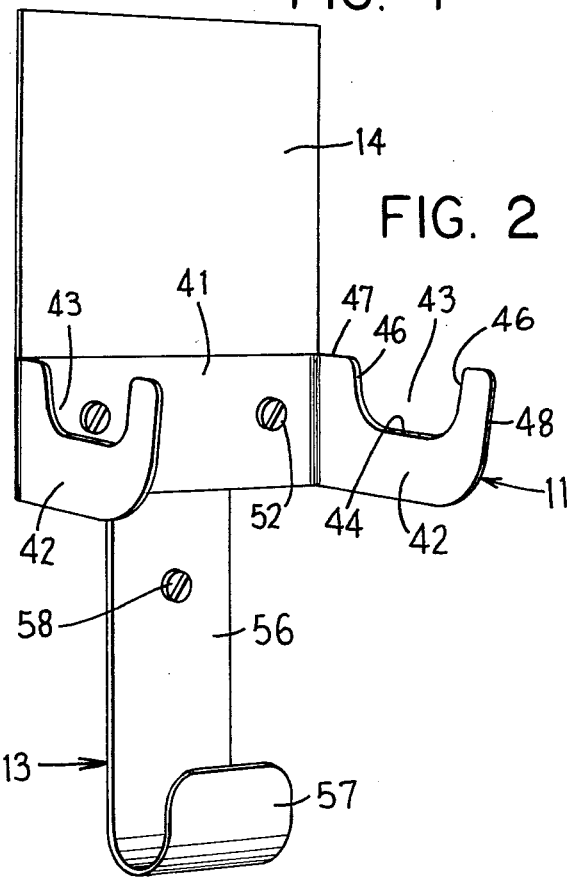
FIG. 2 is a perspective view similar to FIG. 1 but illustrating the ash tray removed from its supporting bracket.

The assembly 10 can also be provided with the article-support hook 13 which, as illustrated by FIGS. 1 and 2, is mountable on the wall directly below the bracket 11 so as to permit the convenient supporting of an article thereon. This article-support hook 13 includes a vertically elongated base part 56 which again comprises a thin but vertically enlarged plate having substantial width and also having a length which is several times larger than its width. The vertical length of the hook is approximately equal to the horizontal width of the bracket. This platelike base part 56, at its lower free end, terminates in a hook part 57 which curves outwardly and upwardly so as to define an upwardly opening recess which is of substantial width, the opening to this hook part being generally at least one inch. The base part 56, which has the upper edge thereof substantially abutted against and centrally positioned relative to the lower edge of the bracket bight, is also preferably adhesively secured to the wall or vertical supporting surface. The base part 56 also preferably has an opening therethrough, and a suitable fastener such as a screw 58 extends therethrough for secure engagement with the supporting wall.

The accent plate 14 is positionable above the bracket bight 41. This plate 14 is formed as a thin but vertically enlarged platelike member which is rectangular or square. The plate 14 has a width which corresponds to the horizontal width of the bight 41, and the lower edge of the accent plate substantially abuts the upper edge of the bight 41. This accent plate 14 is preferably of metal and is also suitably adhesively secured to the supporting wall or surface, and hence provides a protective layer over the wall or supporting surface in that region located directly above the ash receptacle.

The bracket 11, hook 13 and accent plate 14 are all preferably individually formed from thin metal plate since this greatly facilitates the efficient and economical manufacture of the elements and minimizes material waste. Further, this thus enables the bracket and ash tray assembly to be utilized in situations where use of the accent plate and/or hook is not required or deemed desirable. However, it will be appreciated that the wall bracket, accent plate and hook could all be fixedly and rigidly joined together, such as by being formed integrally of one piece, if desired.

The ash tray 12 is preferably molded from a hard plastics material so as to enable it to be of a thin-walled construction and hence be of light weight.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a wall-mountable ash tray assembly having a bracket mountable on a vertical support surface and an ash tray removably supported on the bracket, comprising the improvement wherein:

said bracket comprises a one-piece U-shaped member having a substantially planar bight which overlies the support surface and a pair of substantially parallel planar arms which are fixed to opposite ends of the bight and project horizontally forwardly therefrom in substantially perpendicular relationship thereto, said bracket being integrally formed in one piece from a thin sheetlike material so that the bight and arms are of substantial height, each said arm having a shallow horizontally elongated recess formed therein and extending longitudinally thereof, said recess being located intermediate the ends of the respective arm and opening upwardly through the top edge thereof so that each arm has an upwardly opening U-shaped configuration, said shallow recess being elongated in the longitudinal direction of the respective arm and being defined by a substantially straight bottom edge, said arms terminating in free ends which are rounded, said free ends being positioned so as to not project forwardly beyond the front wall of the ash tray; and said ash tray including a main receptacle portion having an upwardly-opening boxlike configuration, said main body portion being positioned between said arms so as to substantially wholly occupy the region defined within said U-shaped bracket whereby said body portion has side walls which are positioned closely adjacent said arms and closely adjacent said bight, said ash tray also having a pair of upwardly-opening cup-shaped portions fixed to the opposite side walls of the main body portion and projecting outwardly therefrom in opposite directions, said cup-shaped portions extending outwardly through said recesses for supporting said ash tray on said arms, said cup-shaped portion having a cross section which closely conforms to the shape of said recess so that the cup-shaped portion is snugly confined by the recess so that the ash tray can be removed from the bracket solely by upward displacement of the ash tray relative to the bracket.

2. An assembly according to claim 1, including an article-support hook associated with said bracket and fixedly mounted on said support surface directly below said bight, said hook being formed from a wide and elongated piece of thin platelike material so that the hook includes a vertically elongated platelike base portion which is secured to the supporting surface and has the upper end thereof positioned directly adjacent the lower edge of said bight, said base portion at its lower end terminating in a hook part which curves outwardly and upwardly for defining an upwardly opening recess, said hook part being disposed downwardly a substantial distance directly below said ash tray.

3. An assembly according to claim 2, including a thin rectangular metal plate secured to said support surface directly above said bracket, said rectangular plate having a horizontal width which substantially equals the width of the bracket bight, and said plate having the lower edge thereof positioned closely adjacent the upper edge of said bight so as to effectively constitute an upward extension thereof.

4. An assembly according to claim 1, wherein the cup-shaped portions have the upper edges thereof substantially coplanar with the upper edge of the main receptacle portion of the ash tray, said cup-shaped portion having a bottom wall which joins to the adjacent side wall of the main receptacle portion at a location which is approximately vertically midway of the side wall, the shallow recess as formed in the bracket arm having a depth which substantially corresponds to the height of the cup-shaped portion, and said ash tray and said arms being of substantially the same height whereby said ash tray when supported on the bracket is disposed with the upper and lower edges thereof substantially coplanar with the respective upper and lower edges of the bracket.

* * * * *